US005412554A

United States Patent [19]

Lee

[11] Patent Number: 5,412,554

[45] Date of Patent: May 2, 1995

[54] COMPOUND LAMP SHADE FRAME

[76] Inventor: Deng-Ran Lee, 2nd Fl., No. 31, Lane 354, Chung Yang N. Rd., Sec. 4, Taipei, Taiwan, Prov. of China

[21] Appl. No.: 230,986

[22] Filed: Apr. 21, 1994

[51] Int. Cl.[6] ..... F21V 17/02

[52] U.S. Cl. ..... 362/449; 362/417; 362/358

[58] Field of Search ..... 362/417, 449, 450, 451, 362/358

[56] References Cited

U.S. PATENT DOCUMENTS 1,974,077 9/1934 Lynch ..... 362/417 X 3,281,589 10/1966 Cronan ..... 362/449 X

*Primary Examiner*—Stephen F. Husar

*Attorney, Agent, or Firm*—W. Wayne Liauh

[57] ABSTRACT

A compound lamp shade frame comprising: a fixing base adapted to be fastened to a lamp holder and a frame fastened the fixing base. The compound lamp shade is characterized in that: (1) the fixing base is shaped like a ring and has a round opening so as to be fitted on the lamp holder and two fixing wings on it two sides; (2) the frame comprises two sleeves to be respectively screw-fastened onto the fixing wings, two extending harps being respectively fitted into the sleeves, and a finial disposed on the top of the extending harps and connecting both of sand extending harps therebetween; (3) each of the sleeves is a hollow pipe to be fastened onto the wing and has screw holes at both of its ends, respectively; (4) each of the extending harps has a rod capable of inserting into the hollow pipe of the sleeve and capable of moving up and down along the hollow pipe, the rod is adapted to be fastened into the sleeve by screw via one of the screw holes; (5) the finial is provided with a finial screw so as to allow a lamp shade to mounted thereto via a screw cap.

2 Claims, 3 Drawing Sheets

COMPOUND LAMP SHADE FRAME

BACKGROUND OF THE INVENTION

Generally, the conventional lampshade frame is directly installed on the lampshade. Its main problem is that the height of the frame can not be adjusted so as to meet the need for different height of any type of lampshade; on the other hand, partly because the specification of each lamp holder is different from each other, partly because the fixing base of the lampshade frame can not be changed, it can not fit the lamp holder of different specification. As shown in FIG. 1, the frame of a conventional lampshade are secured in the lampshade, therefore, because the lampshade frame can not be folded or piled up, so the finished lamp product will take a larger space, and it will cause a greater cost to store, move and deliver the lamp, and make itself inconvenient to handle.

SUMMARY OF THE INVENTION

The object of the present invention is to provide a compound lampshade frame which can meet the need for different height of any type of lampshade, which can fit the lamp holder of different specification, easy to be folded and piled up so as save the cost for storage and delivery and to be convenient to handle.

The structural characteristics of the invention can be described as follows:

Design a lampshade frame to be a compound lampshade frame which consists of a fixing base connected to a lamp holder, two fixing sleeves, a unit of extending harps, and a lampshade, the characteristic of the frame is that the extending harp can be either moved up and down or positioned in the sleeve so that it can fit various types of lampshades, small or large, high or low; and the fixing base can be changed according to the specification of a lampholder, so it is easy to mass produce the present invention, and easy to assemble, fold, store, deliver and manipulate the compound lampshade frame so that its cost can be lowered down.

DETAILED DESCRIPTION

Figure 1:
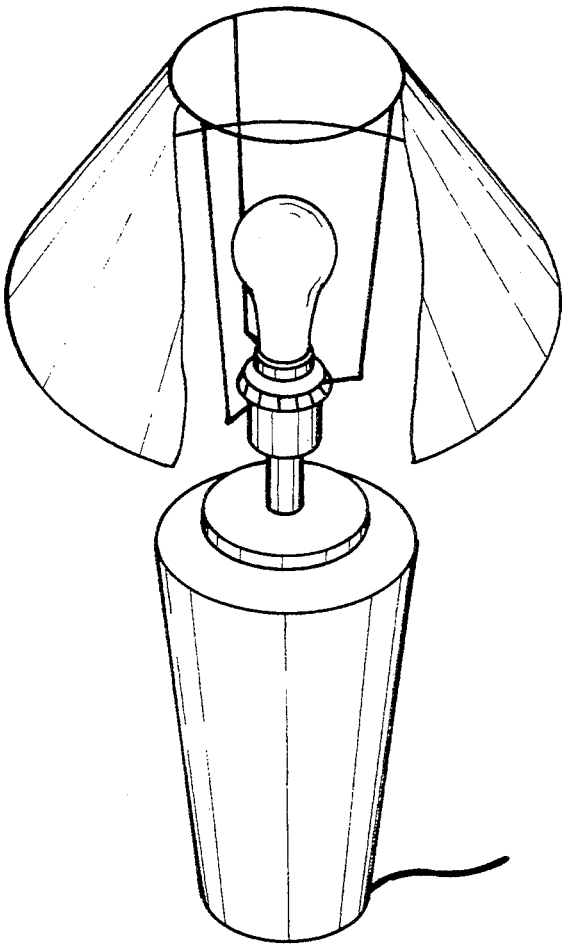
FIG. 1 shows a conventional type of lampshade connected to a lamp socket.
Figure 2:
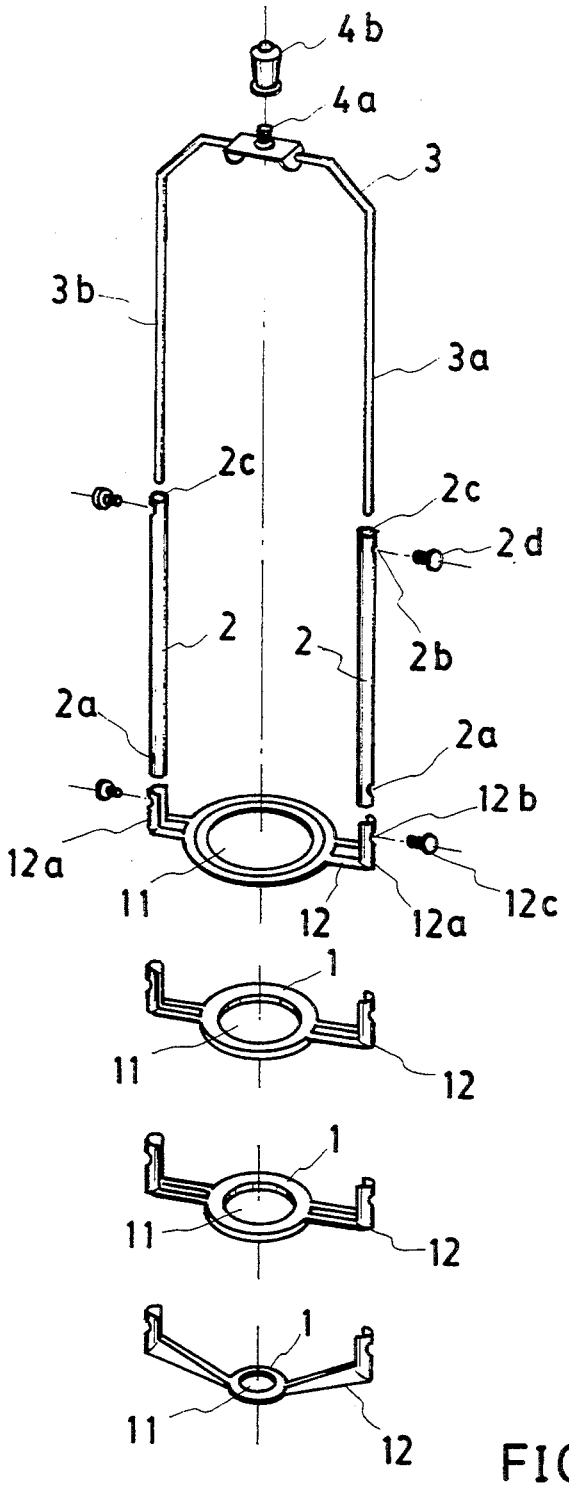
FIG.2 shows a sectional view of the invention.
Figure 3:
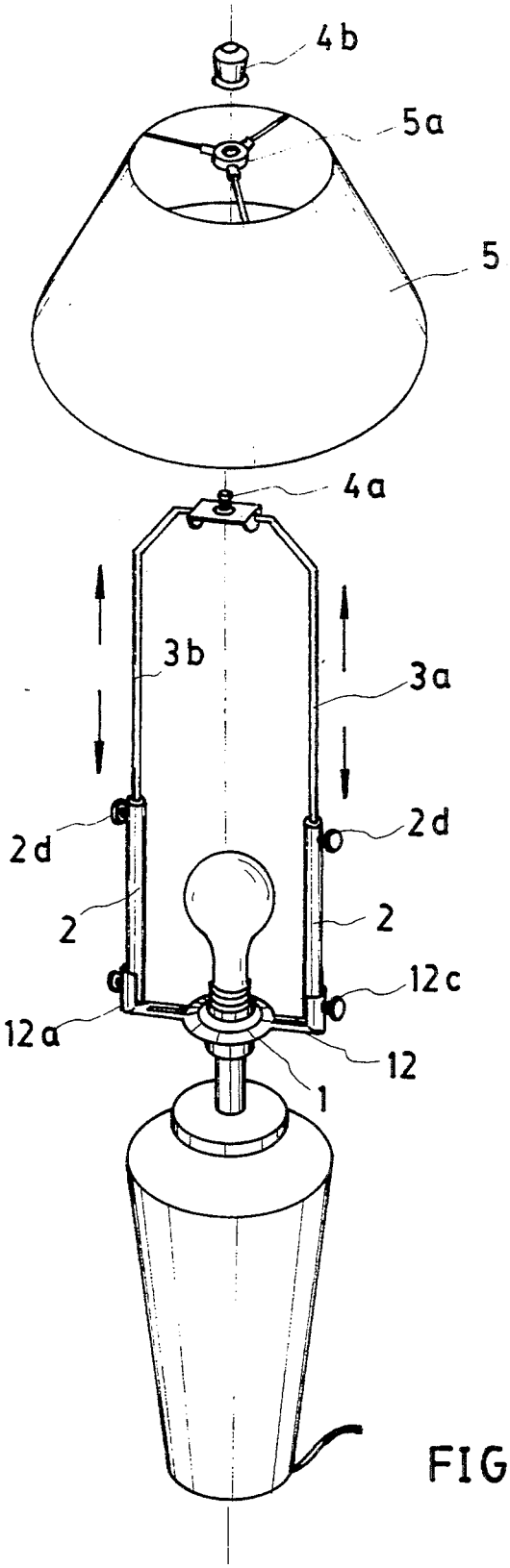
FIG.3 shows a sectional view of an embodiment of the invention.

As shown in FIG. 2,3, a compound lampshades frame consists of a fixing base 1 fastened to a lamp holder and a frame fastened to the fixing base 1, its characteristic is that the fixing base 1, shaped like a ring, has a round opening 11 which fits the lamp holder and has two fixing wings 12 on it two sides, and two sleeves 2 are respectively screw fastened on the fixing wings 12, two extending harps are respectively fitted into the sleeves 2, and a finial 4 is disposed on the top of the extending harps 3, the frame is comprised of the sleeves 2, the extending harps 3, and the finial 4, wherein the sleeve 2 is a hollow pipe which is fastened on the wing 12, the sleeve 2 has screw holes 2*a*, 3*b*, at its both ends, the extending harp 3 has two rods 3*a*, 3*b*, which can insert into the hole 2*c* of the sleeve 2 and can move up and down along the hole 2*c*; the rods 3*a*, 3*b* can be fastened in the sleeves 2 by screw 2*d*; a lampshade 5 and a finial 4 are mounted on the top of the extending harps 3, the lampshade 5 is fastened on the finial 4 by means of screw 4*a* and screw cap 4*b*.

The lampshade frame is fitted between the lamp holder and the lampshade, by means of moving the extending rods 3*a*, 3*b* of the harp 3 up and down at the hole 2*c*, the frame can be adjusted to fit the height of small or large lampshade, and a series of the fixing base with opening in different size can be provided so that lampholder of different size can use the fixing base with opening in different size and that the invention can meet various needs for a lampshade of different height.

To make the compound lampshade frame easy to be folded and piled up, a vertical bracket 12*a* is provided on the fixing wings 12 of the fixing base 1, the vertical bracket 12*a* has a screw hole 12*b* and a screw 12*c* is provided to fasten the sleeve 2 and the wing 12 easily; they are also easy to take apart when the finished frame is to be folded or piled up, so it will take little space and be easy to store and de liver, and so it can save much cost.

The invention claimed is:

1. A compound lamp shade frame comprising:

a fixing base adapted to be fastened to a lamp holder and a frame fastened to said fixing base;

said compound lamp shade being characterized in that said fixing base being shaped like a ring and having a round opening so as to be fitted on said lamp holder and two fixing wings on its two sides said frame comprising two sleeves to be respectively screw-fastened onto said fixing wings, two extending harps being respectively fitted into said sleeves, and a finial disposed on the top of said extending harps and connecting both of said extending harps therebetween;

each of said sleeves being a hollow pipe to be fastened onto said wing, said sleeve having a screw hole at its upper end;

each of said extending harps having a rod capable of inserting into said hollow pipe of said sleeve and capable of moving up and down along said hollow pipe, said rod being adapted to be fastened into said sleeve by screw via said screw hole;

said finial being provided with a finial screw so as to allow a lamp shade to mounted thereto via a screw cap.

2. A compound lamp shade frame as claimed in claim 1 which is further characterized in that a vertical bracket being provided with each of said fixing wings of the fixing base, the vertical bracket having a base screw hole matching a lower screw hole provided in a lower portion of said sleeve so as to allow a screw to insert through said base screw hole and said lower screw hole and easily fasten said sleeve and the wing together.

* * * * *